US011187238B2

(12) United States Patent
Yamamoto et al.

(10) Patent No.: US 11,187,238 B2
(45) Date of Patent: Nov. 30, 2021

(54) PROPELLER FAN, AIR-SENDING DEVICE, AND REFRIGERATION CYCLE APPARATUS

(71) Applicant: Mitsubishi Electric Corporation, Tokyo (JP)

(72) Inventors: Katsuyuki Yamamoto, Tokyo (JP); Takuya Teramoto, Tokyo (JP); Takahide Tadokoro, Tokyo (JP); Hiroya Ito, Tokyo (JP); Yuki Ugajin, Tokyo (JP); Shingo Hamada, Tokyo (JP); Takashi Ikeda, Tokyo (JP); Takafumi Abe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 16 days.

(21) Appl. No.: 16/620,619

(22) PCT Filed: Aug. 9, 2017

(86) PCT No.: PCT/JP2017/028958
§ 371 (c)(1),
(2) Date: Dec. 9, 2019

(87) PCT Pub. No.: WO2019/030867
PCT Pub. Date: Feb. 14, 2019

(65) Prior Publication Data
US 2021/0003140 A1 Jan. 7, 2021

(51) Int. Cl.
*F04D 29/34* (2006.01)
*F04D 29/38* (2006.01)

(52) U.S. Cl.
CPC ..... *F04D 29/34* (2013.01); *F04D 29/388* (2013.01)

(58) Field of Classification Search
CPC .... F04D 17/025; F04D 19/002; F04D 29/329; F04D 29/34; F04D 29/388
See application file for complete search history.

(56) References Cited

U.S. PATENT DOCUMENTS 6,565,320 B1 * 5/2003 Suris ..... F04D 29/329 416/175
6,942,457 B2 * 9/2005 Pennington ..... F01D 5/30 416/144
(Continued)

FOREIGN PATENT DOCUMENTS

CN 203548330 U 4/2014
CN 104895837 A 9/2015
(Continued)

OTHER PUBLICATIONS

International Search Report of the International Searching Authority dated Oct. 31, 2017 for the corresponding International application No. PCT/JP2017/028958 (and English translation).
(Continued)

*Primary Examiner* — Jesse S Bogue
(74) *Attorney, Agent, or Firm* — Posz Law Group, PLC

(57) ABSTRACT

A propeller fan includes a cylindrical shaft portion provided on a rotation axis of the propeller fan; a plurality of blades provided on an outer peripheral side of the shaft portion; a connection portion provided adjacent to the shaft portion and connecting two of the plurality of blades that are adjacent to each other in a circumferential direction of the propeller fan; a first rib provided on at least one of a pressure surface of each of the plurality of blades and a surface of part of the connection portion that is located on a downstream side in the flow of air, and a second rib provided on at least one of a negative-pressure surface of each of the plurality of blades and a surface of part of the connection portion that is located on an upstream side in the flow of air.

10 Claims, 11 Drawing Sheets

(56) References Cited

U.S. PATENT DOCUMENTS

| | | | | |
|---|---|---|---|---|
| 8,240,996 | B2 * | 8/2012 | Suris | F04D 29/325 416/169 A |
| 9,447,791 | B2 * | 9/2016 | Aschermann | F04D 29/384 |
| 10,578,320 | B2 * | 3/2020 | Sawada | F24F 1/06 |
| 10,767,656 | B2 * | 9/2020 | Hamada | F04D 29/34 |
| 2011/0200445 | A1 | 8/2011 | Takeda et al. | |
| 2012/0321467 | A1 * | 12/2012 | He | F04D 29/388 416/144 |
| 2018/0003190 | A1 | 1/2018 | Hamada et al. | |
| 2020/0018321 | A1 * | 1/2020 | Teramoto | F04D 29/384 |
| 2020/0166048 | A1 * | 5/2020 | Teramoto | F04D 29/053 |

FOREIGN PATENT DOCUMENTS

| | | | |
|---|---|---|---|
| JP | 4-388993 | B1 | 10/2009 |
| JP | 2011-163259 | A | 8/2011 |
| JP | 2013-517406 | A | 5/2013 |
| WO | 2016/021555 | A1 | 11/2016 |

OTHER PUBLICATIONS

Examination Report dated Sep. 18, 2020 issued in corresponding AU patent application No. 2017427465.
Office Action dated Jul. 14, 2020 issued in corresponding JP patent application No. 2019-535514 (and English translation).
Extended European Search Report dated Jul. 15, 2020 issued in corresponding European patent application No. 17921060.4.
Office Action dated Jul. 24, 2020 issued in corresponding CN patent application No. 201780093366.X (and English translation).

* cited by examiner

PROPELLER FAN, AIR-SENDING DEVICE, AND REFRIGERATION CYCLE APPARATUS

CROSS REFERENCE TO RELATED APPLICATION

This application is a U.S. national stage application of PCT/JP2017/028958 filed on Aug. 9, 2017, the contents of which are incorporated herein by reference.

TECHNICAL FIELD

The present invention relates to a propeller fan including a plurality of blades, an air-sending device, and a refrigeration cycle apparatus.

BACKGROUND ART

Patent Literature 1 describes an axial fan that includes a plurality of blades. Of the plurality of blades, blades adjacent to each other in a rotation direction of the fan are located such that a leading edge of one of the adjacent blades is connected to a trailing edge of the other of the adjacent blades by a plate-shaped connection portion. On a pressure surface of each of the plurality of blades, plate-shaped reinforcing ribs are provided to extend from an area surrounding a rotation axis toward an outer peripheral edge of each blade.

CITATION LIST

Patent Literature

Patent Literature 1: International Publication No. 2016/021555

SUMMARY OF INVENTION

Technical Problem

Around the rotation axis of the axial fan described in Patent Literature 1, a cylindrical shaft hole portion, a cylindrical portion, and a plurality of coupling ribs are formed. The cylindrical shaft hole portion allows a drive shaft of a motor to be fitted in the shaft hole portion. The cylindrical portion is formed coaxial with the shaft hole and supports the shaft hole portion from an outer peripheral side thereof. The plurality of coupling ribs are provided between the shaft hole portion and the cylindrical portion. The cylindrical portion is slightly larger than the shaft hole portion. When the axial fan is operated, relatively large stagnation regions are formed upstream and downstream of the cylindrical portion along the rotation axis. The stagnation regions reduce the air-sending efficiency of the axial fan.

The present invention has been made to solve the above problem, and an object of the invention is to provide a propeller fan, an air-sending device, and a refrigeration cycle apparatus that improve the air-blowing efficiency.

Solution to Problem

A propeller fan according to an embodiment of the present invention includes: a cylindrical shaft portion provided on a rotation axis of the propeller fan; a plurality of blades provided on an outer peripheral side of the shaft portion; a connection portion provided adjacent to the shaft portion and connecting two of the plurality of blades that are adjacent to each other in a circumferential direction of the propeller fan; a first rib provided on at least one of a pressure surface of each of the plurality of blades and a surface of part of the connection portion that is located on a downstream side in the flow of air, the first rib extending outwards from the shaft portion in a radial direction of the propeller fan; and a second rib provided on at least one of a negative-pressure surface of each of the plurality of blades and a surface of part of the connection portion that is located on an upstream side in the flow of air, the second rib extending outwards from the shaft portion in the radial direction.

An air-sending device according to another embodiment of the present invention includes the propeller fan according to the embodiment of the present invention.

A refrigeration cycle apparatus according to a still another embodiment of the present invention includes the air-sending device according to the embodiment of the present invention.

Advantageous Effects of Invention

According to the embodiment of the present invention, first ribs and second ribs structurally reinforce the shaft portion, a plurality of blades, and a plurality of connection portions. Thereby, the shaft portion can be formed to have a smaller diameter, and the size of stagnation regions generated upstream and downstream of the shaft portion can be reduced. The first ribs and the second ribs can generate air flows downstream and upstream of the shaft portion, whereby the stagnation regions generated downstream and upstream of the shaft portion can be further reduced. Thus, in the embodiment of the present invention, it is possible to improve an air-sending efficiency of the propeller fan.

DESCRIPTION OF EMBODIMENTS

Embodiment 1

Figure 1:
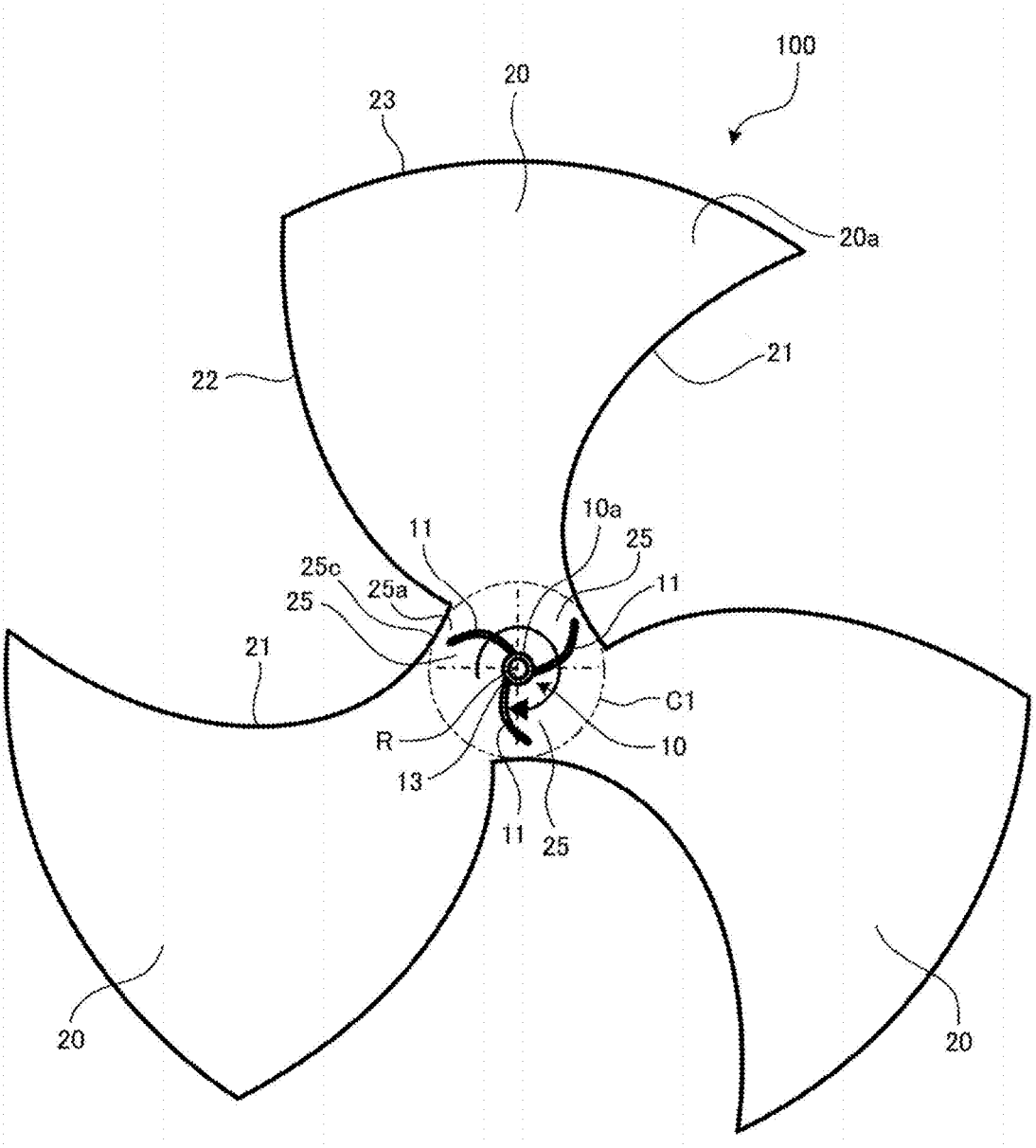
FIG. 1 is a front view of a configuration of a propeller fan 100 according to Embodiment 1 of the present invention.
Figure 2:
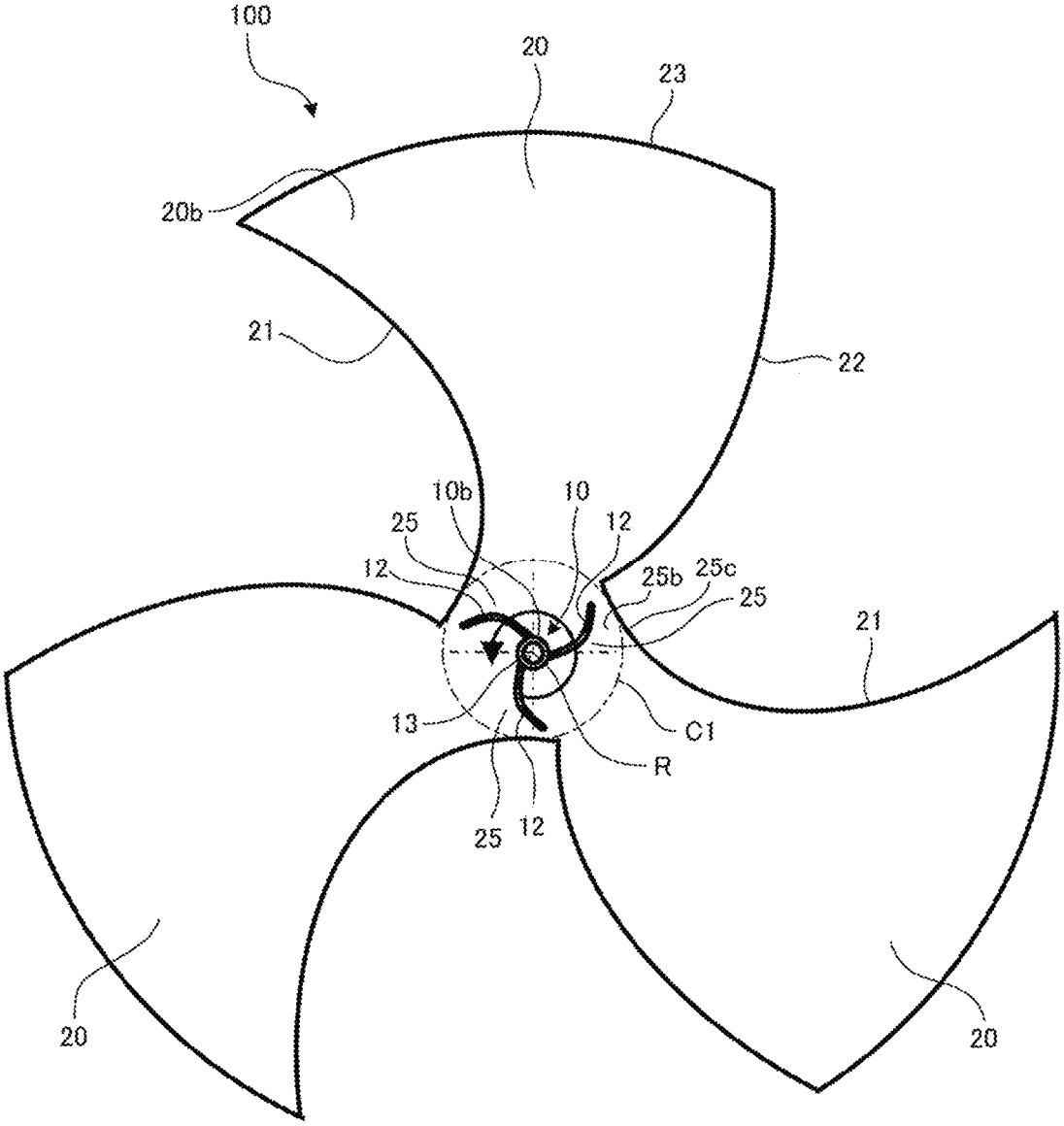
FIG. 2 is a back view of the configuration of the propeller fan 100 according to Embodiment 1 of the present invention.

A propeller fan according to Embodiment 1 of the present invention will be described. A propeller fan is employed in a refrigeration cycle apparatus such as an air-conditioning apparatus, or in a ventilator. FIG. 1 is a front view of a configuration of a propeller fan 100 according to Embodiment 1. FIG. 2 is a back view of the configuration of the propeller fan 100 according to Embodiment 1. FIG. 1 illustrates the configuration of the propeller fan 100 as viewed from a positive-pressure surface 20*a*. FIG. 2 illustrates the configuration of the propeller fan 100 as seen from a negative-pressure surface 20*b*. As illustrated in FIGS. 1 and 2, the propeller fan 100 includes a cylindrical shaft portion 10 that is provided on a rotation axis R and is rotated around the rotation axis R, a plurality of blades 20 that are provided on an outer peripheral side of the shaft portion 10, and a plurality of connection portions 25 each of which connects associated two of the blades 20 that are adjacent to each other in a circumferential direction of the propeller fan 1. The propeller fan 100 are provided as united blades in which the shaft portion 10, the plurality of blades 20, and the plurality of connection portions 25 are formed of, for example, resin and integral with each other. The way of forming the propeller fan 100 is not limited to molding of the propeller fan using resin. The propeller fan 100 may be molded and formed of a sheet metal. The propeller fan 100 is a propeller fan not including a boss, that is, a so-called bossless propeller fan. The rotation direction of the propeller fan 100 (or may be also referred to as a rotation direction of the shaft portion 10 in the following description) is a clockwise direction in FIG. 1, and a counterclockwise direction in FIG. 2.

The shaft portion 10 includes a cylindrical downstream-side shaft portion 10*a* and a cylindrical upstream-side shaft portion 10*b*. The cylindrical downstream-side shaft portion 10*a* protrudes along the rotation axis R in a region where the pressure surface 20*a* is located, that is, on a downstream side in the flow of air. The cylindrical upstream-side shaft portion 10*b* protrudes along the rotation axis R in a region where the negative-pressure surface 20*b* is located, that is, on the upstream side of the air flow. The downstream-side shaft portion 10*a* and the upstream-side shaft portion 10*b* are formed coaxial with each other. In an inner peripheral portion of the shaft portion 10, a shaft hole 13 is formed to extend through the shaft portion 10 along the rotation axis R. In the shaft hole 13, a drive shaft 111 of a fan motor 110 is inserted to drive the propeller fan 100 (see to FIG. 19, which will be described later).

The plurality of blades 20 are arranged at substantially regular intervals in a circumferential direction thereof around the rotation axis R. In Embodiment 1, the number of blades 20 is three. Each of the blades 20 includes a leading edge 21, a trailing edge 22, and an outer peripheral edge 23. The leading edge 21 is an edge located on a front side of the blade 20 in the rotation direction of the propeller fan 100. The trailing edge 22 is an edge located on a rear side of the blade 20 in the rotation direction of the propeller fan 100. The outer peripheral edge 23 is an edge located on an outer peripheral side of the blade 20 and between an outer end of the leading edge 21 and an outer end of the trailing edge 22. An inner periphery of each of the plurality of blades 20 is connected with an outer peripheral surface of the shaft portion 10.

Each of the plurality of connection portions 25 is formed in the shape of, for example, a plate, and is provided adjacent to the outer periphery of the shaft portion 10. A surface 25*a* of each of the plurality of connection portions 25, which is located on the downstream side in the flow of air, smoothly connects positive-pressure surfaces 20*a* of associated two blades 20 adjacent to each other in the circumferential direction. A surface 25*b* of each connection portion 25, which is located on the upstream side in the flow of air, smoothly connects negative-pressure surfaces 20*b* of associated two blades 20 adjacent to each other in the circumferential direction. An edge portion 25*c* of each connection portions 25, which is located on an outer peripheral side thereof, connects the trailing edge 22 of one of the associated two blades 20 adjacent to each other in the circumferential direction and the leading edge 21 of the other of the two blades 20, the one of the two blades 20 being located forward of the other of the two blades 20 in the rotation direction. An imaginary cylindrical surface C1, which has a minimum radius from the rotation axis R and is in contact with the edge portions 25*c* of the connection portions 25, is located outward of the outer peripheral surface of the shaft portion 10.

As illustrated in FIG. 1, a plurality of first ribs 11 are provided on the positive-pressure surfaces 20*a* of the plurality of blades 20 and/or downstream-side surfaces 25*a* of the plurality of connection portions 25, such that the first ribs 11 are each formed in the shape of a plate that protrudes in a direction substantially parallel to the rotation axis R. The first ribs 11 may be slightly curved relative to the direction parallel to the rotation axis R. As viewed in the direction parallel to the rotation axis R, each of the first ribs 11 extends outwards from the outer peripheral surface of the downstream-side shaft portion 10*a* in a radial direction of the propeller fan 100, and at least part of each first rib 11 extends over the surface 25*a* of the connection portion 25. The first ribs 11 are arranged at substantially regular intervals in the circumferential direction around the rotation axis R. In Embodiment 1, the first ribs 11 are provided only in an area located inward of the imaginary cylindrical surface C1. However, the first ribs 11 may be further extended to an area located outward of the imaginary cylindrical surface C1. In Embodiment 1, as viewed in the direction parallel to the rotation axis R, the first ribs 11 are provided only in an area located inward of an outer peripheral surface of a housing of the fan motor 110 (not illustrated in FIG. 1). The shape of the first ribs 11 as viewed in the direction parallel to the rotation axis R will be described later.

As illustrated in FIG. 2, a plurality of second ribs 12 are provided on the negative-pressure surfaces 20*b* of the blades 20 and/or the upstream-side surfaces 25*b* of the connection portions 25, such that the second ribs 12 are each formed in the shape of a plate that protrudes in the direction substantially parallel to the rotation axis R. The second ribs 12 may be slightly curved relative to the direction parallel to the rotation axis R. As viewed in the direction parallel to the rotation axis R, each of the second ribs 12 extends outwards from the outer peripheral surface of the upstream-side shaft portion 10*b* in the radial direction of the propeller fan 100, and at least part of each second rib 12 extends over the surface 25*b* of the connection portion 25. The second ribs 12 are arranged at substantially regular intervals in the circumferential direction around the rotation axis R. In Embodiment 1, the second ribs 12 are provided only in an area located inward of the imaginary cylindrical surface C1. However, the second ribs 12 may be further extended to an area located outward of the imaginary cylindrical surface C1. Furthermore, in Embodiment 1, as viewed in the direction parallel to the rotation axis R, the second ribs 12 are provided only in an area located inward of the outer peripheral surface of the housing of the fan motor 110 (not illustrated in FIG. 2). The shape of the second ribs 12 as viewed in the direction parallel to the rotation axis R will be described later.

In Embodiment 1, the number of first ribs 11 and the number of second ribs 12 are both three, and are the same as the number of blades 20. However, the number of first ribs 11 and the number of second ribs 12 are not limited to three. The number of first ribs 11 may be different from the number of second ribs 12. However, in order to improve the balance of the propeller fan 100, preferably, the number of first ribs 11 and the number of second ribs 12 should be set to be an integer number of times greater than or equal to the number of blades 20. Furthermore, in the case where a plurality of propeller fans 100 are stacked together as described later, in order to improve the stability of the propeller fans 100, preferably, the number of first ribs 11 and the number of second ribs 12 should be set greater than or equal to three. Moreover, in order to prevent the propeller fans 100 from wobbling when the propeller fans 11 are stacked, preferably, the number of first ribs 11 and the number of second ribs 12 should be both set to three.

It will be described what advantages are obtained by the above configuration. In the propeller fan 100 according to Embodiment 1, the first ribs 11 provided on the pressure surface 20*a* and the second ribs 12 provided on the negative-pressure surface 20*b* structurally reinforce the shaft portion 10, the blades 20, and the connection portions 25. Thereby, the shaft portion 10 can be made smaller in size and mass, as compared with the configuration as described in Patent Literature 1. Thus, the shaft portion 10 can be formed to have a smaller diameter. It is therefore possible to reduce the size of stagnation regions which are generated upstream and downstream of the shaft portion 10.

Furthermore, the first ribs 11 and the second ribs 12 not only reinforce the shaft portion 10, the blades 20, and the connection portions 25, but aerodynamically act. To be more specific, when the first ribs 11 on the pressure surface 20*a* are rotated, air in the stagnation region generated downstream of the shaft portion 10 is diffused. The air diffused from the stagnation region is supplied to a mainstream region generated by rotation of the blades 20 in a region located outward of the stagnation region. Thus, the stagnation region is further reduced in size, and the air-sending efficiency of the propeller fan 100 is improved.

Furthermore, when the second ribs 12 on the negative-pressure surface 20*b* are rotated, a centrifugal force is transmitted to air, as a result of which air flows outwards from the vicinity of the upstream-side shaft portion 10*b* in the radial direction. Thereby, the air in the vicinity of the upstream-side shaft portion 10*b* is supplied to the mainstream area. The vicinity of the upstream-side shaft portion 10*b* from which air has flowed out is supplied with air from an upstream side of the upstream-side shaft portion 10*b*. Thus, on the upstream side of the shaft portion 10 where a stagnation region is generated, an airflow toward the upstream-side shaft portion 10*b* is generated. Thereby, the stagnation region is further reduced and an air flow passage is enlarged, thus improving the air-sending efficiency of the propeller fan.

Figure 19:
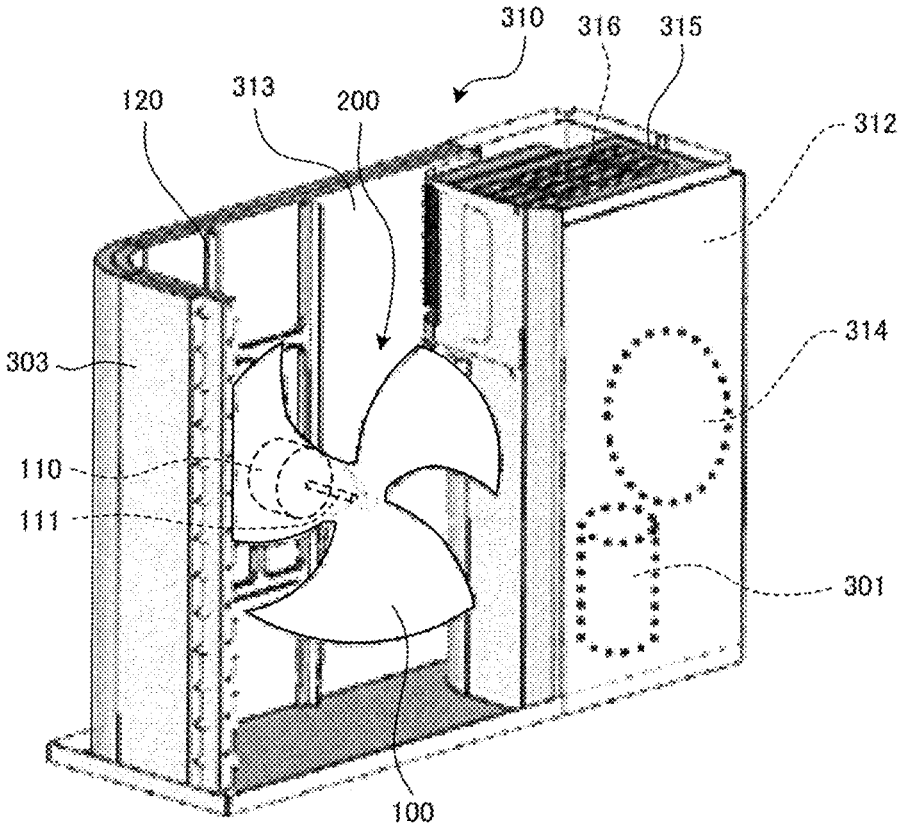
FIG. 19 is a perspective view of an internal configuration of an outdoor unit 310 of the refrigeration cycle apparatus 300 according to Embodiment 4 of the present invention.

In an area located upstream of the propeller fan 100, as illustrated in FIG. 19 which will be referred to later, in many cases, the fan motor 110 and a support element 120 that supports the fan motor 110 are provided upstream of the propeller fan 100. In this case, in the area located upstream of the propeller fan 100, stagnation more easily occurs. Therefore, in Embodiment 1, the second ribs 12 are more effective in an air-sending device that includes the propeller fan 100 and the fan motor 110 provided upstream of the propeller fan 100.

Each of the first ribs 11 may be provided on the pressure surface 20*a* of an associated one of the blades 20 and the surface 25*a* of an associated one of connection portions 25, or may be provided only on the pressure surface 20*a* of the associated blade 20, or only on the surface 25*a* of the associated connection portion 25. In the case where at least part of each first rib 11 is provided on the surface 25*a* of the associated connection portion 25, it can have an aerodynamic effect on the connection portion 25, which serves to connect associated adjacent blades 20. Also, in the case where at least part of each first rib 11 is provided on the surface 25*a* of the connection portion 25, the first rib 11 can reinforce the connection portion 25, on which stress easily concentratedly acts.

Similarly, each of the second ribs 12 may be provided on the negative-pressure surface 20*b* of an associated blade 20 and the surface 25*b* of an associated connection portion 25. Alternatively, each second rib 12 may be provided only on the negative-pressure surface 20*b* of the associated blade 20, or only on the surface 25*b* of the associated connection portion 25. In the case where at least part of each second rib 12 is provided on the surface 25*b* of the associated connection portion 25, it can have an aerodynamic effect on the connection portion 25, which serves to connect associated adjacent blades 20. In the case where at least part of each second rib 12 is provided on the surface 25*b* of the associated connection portion 25, the second rib 12 can reinforce the connection portion 25, on which stress easily concentrately acts.

Next, the shapes of the first ribs 11 as viewed in the direction parallel to the rotation axis R will be described.

Figure 3:
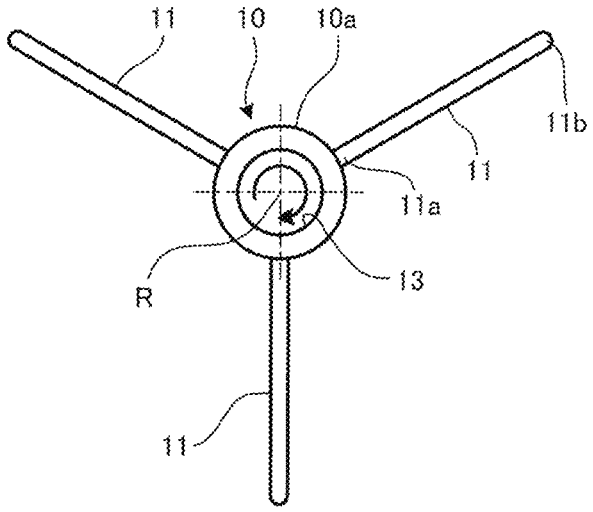
FIG. 3 illustrates a first example of the shape of first ribs 11 of the propeller fan 100 according to Embodiment 1 of the present invention.

FIG. 3 illustrates a first example of the shape of each of the first ribs 11. FIG. 3 and FIGS. 4 to 7, which will be described later, illustrate the shapes of the first ribs 11 as viewed from the pressure surface 20*a*. It should be noted that with respect to each first rib 11 as viewed in the direction parallel to the rotation axis R, an inner end of the first rib 11 in the radial direction that is connected to the downstream-side shaft portion 10*a* will be referred to as a first proximal end portion 11*a*, and an outer end of the first rib 11 in the radial direction that is located outward of the first proximal end potion 11*a* will be referred to as a first distal end portion 11*b*. As illustrated in FIG. 3, in the first example, the first ribs 11 linearly extend from the first proximal end portions 11*a* to the first distal end portions 11*b* in the radial direction from the rotation axis R.

Figure 4:
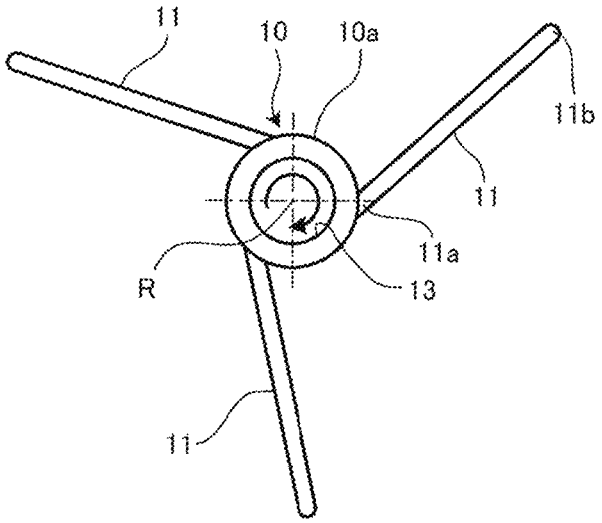
FIG. 4 illustrates a second example of the shape of the first ribs 11 of the propeller fan 100 according to Embodiment 1 of the present invention.

FIG. 4 illustrates a second example of the shape of the first ribs 11. As illustrated in FIG. 4, in the second example, the first ribs 11 have the same shapes as those of turbo blades. To be more specific, the first distal end portion 11*b* is located rearward of the first proximal end portion 11*a* in the rotation direction of the propeller fan 100. Each of the first ribs 11 extends linearly from its first proximal end portion 11*a* to its first distal end portion 11*b* while inclined rearwards in the rotation direction relative to the radial direction from the rotation axis R.

Figure 5:
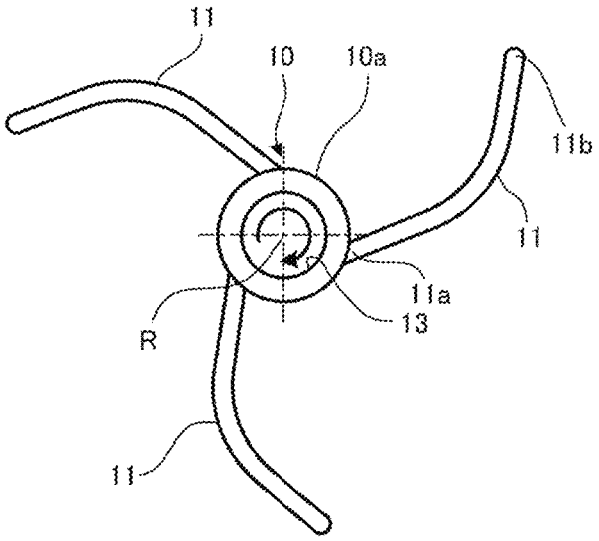
FIG. 5 illustrates a third example of the shape of the first ribs 11 of the propeller fan 100 according to Embodiment 1 of the present invention.

FIG. 5 illustrates a third example of the shape of the first ribs 11. As illustrated in FIG. 5, in the third example, the first ribs 11 also have the same shapes as those of turbo blades as in the second example. To be more specific, the first distal end portion 11*b* is located rearward of the first proximal end portion 11*a* in the rotation direction of the propeller fan 100. Part of each of the first ribs 11 that is located between the first proximal end portion 11*a* and the first distal end portion 11*b* of each first rib 11 is curved or bent rearwards in the rotation direction.

Figure 6:
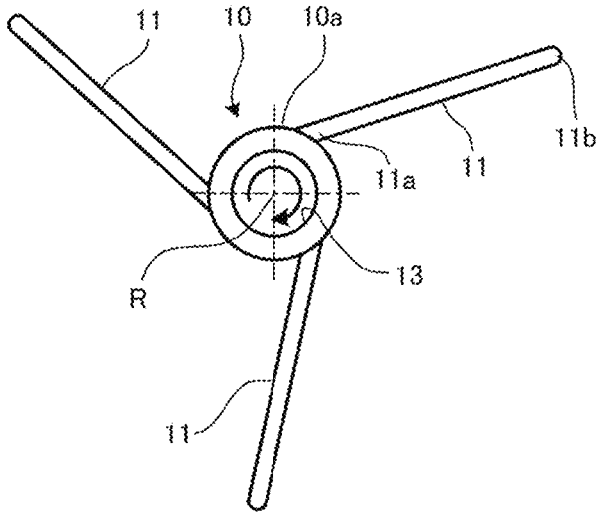
FIG. 6 illustrates a fourth example of the shape of the first ribs 11 of the propeller fan 100 according to Embodiment 1 of the present invention.

FIG. 6 illustrates a fourth example of the shape of the first ribs 11. As illustrated in FIG. 6, in the fourth example, the first ribs 11 have the same shapes as those of sirocco blades. To be more specific, the first distal end portion 11*b* is located forward of the first proximal end portion 11*a* in the rotation direction of the propeller fan 100. Each of the first ribs 11 linearly extends from its first proximal end portion 11*a* to its first distal end portion 11*b* while inclined forwards in the rotation direction relative to the radial direction from the rotation axis R.

Figure 7:
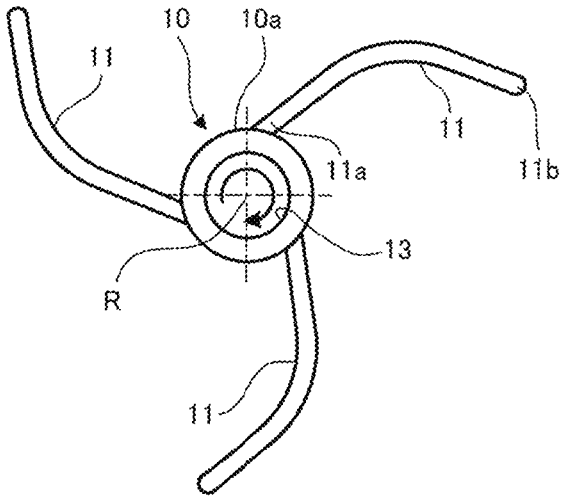
FIG. 7 illustrates a fifth example of the shape of the first ribs 11 of the propeller fan 100 according to Embodiment 1 of the present invention.

FIG. 7 illustrates a fifth example of the shape of the first ribs 11. As illustrated in FIG. 7, in the fifth example, the first ribs 11 have shapes corresponding those of sirocco blades as in the fourth example. To be more specific, the first distal end portion 11*b* is located forward of the first proximal end portion 11*a* in the rotation direction of the propeller fan 100. Part of each of the first ribs 11 that is located between the first proximal end portion 11*a* and the first distal end portion 11*b* is also curved or bent forwards in the rotation direction.

All the first ribs 11 that are of different types as illustrated in FIGS. 3 to 7 can aerodynamically act as described above. Therefore, even if any type of first ribs 11 which are selected from all the types of the first ribs 11 as illustrated in FIGS. 3 to 7 are applied, the applied first ribs 11 can improve the air-sending efficiency of the propeller fan 100. Especially, in the case where of all the types of the first ribs, the first ribs 11 having the same shapes as those of the turbo fan as illustrated in FIGS. 4 and 5 are applied, they can reduce an air resistance during the rotation of the first ribs 11, and thus can further improve the efficiency of the propeller fan 100. Particularly, the first ribs 11 curved or bent rearwards in the rotation direction as illustrated in FIG. 5 can more greatly reduce the air resistance than the first ribs 11 as illustrated in FIG. 4.

Figure 8:
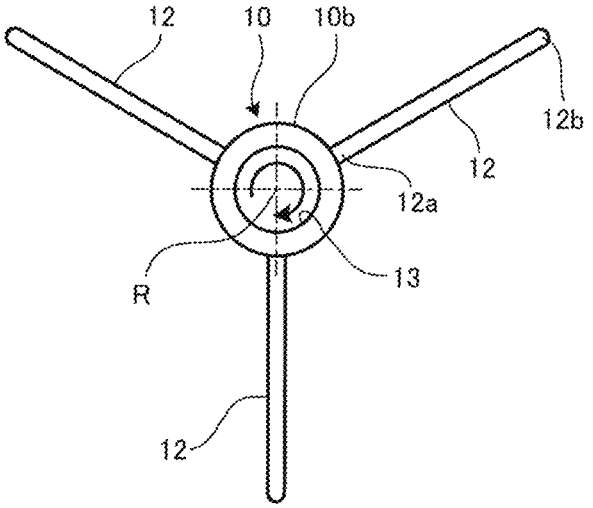
FIG. 8 illustrates a first example of the shape of second ribs 12 of the propeller fan 100 according to Embodiment 1 of the present invention.

The shape of the second ribs 12 as viewed in the direction parallel to the rotation axis R will now be described. FIG. 8 illustrates a first example of the shape of the second ribs 12. Unlike FIG. 2, FIG. 8 and FIGS. 9 to 12, which will be described later, are transparent views illustrating the shapes of the second ribs 12 as viewed from the pressure surface 20. To be more specific, in FIGS. 8 to 12, the second ribs 12 are viewed in the same direction as the first ribs 11 are viewed in FIGS. 3 to 7 described above. Thus, the rotation direction of the shaft portion 10 in FIGS. 8 to 12 is the clockwise direction and is the same as the rotation direction of the shaft portion 10 in FIGS. 3 to 7. It should be noted that in each of the second ribs 12 as viewed in the direction parallel to the rotation axis R, an inner end of each second rib 12 in the radial direction that is connected to the upstream-side shaft portion 10*b* will be referred to as a second proximal end portion 12*a*, and an outer end of each second rib 12 in the radial direction that is located outward of the second proximal end portion 12*a* will be referred to as a second distal end portion 12*b*. As illustrated in FIG. 8, in the first example, the second ribs 12 linearly extends from the second proximal end portion 12*a* to the second distal end portion 12*b* in the radial direction from the rotation axis R.

Figure 9:
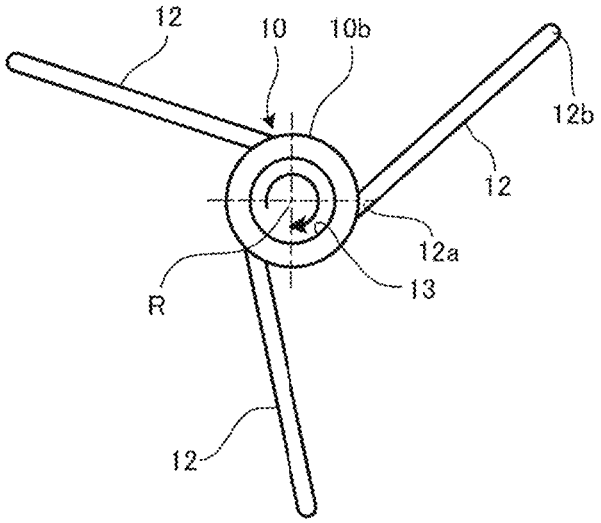
FIG. 9 illustrates a second example of the shape of the second ribs 12 of the propeller fan 100 according to Embodiment 1 of the present invention.

FIG. 9 illustrates a second example of the shape of the second ribs 12. As illustrated in FIG. 9, in the second example, the second ribs 12 have the same shapes as those of turbo blades. To be more specific, the second distal end portion 12*b* is located rearward of the second proximal end portion 12*a* in the rotation direction of the propeller fan 100. Each of the second ribs 12 linearly extend from the second proximal end portion 12*a* to the second distal end portion 12*b* while inclined rearward in the rotation direction relative to the radial direction from the rotation axis R.

Figure 10:
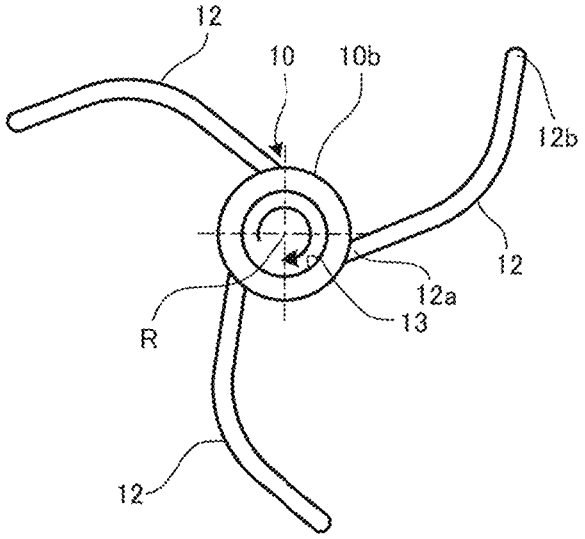
FIG. 10 illustrates a third example of the shape of the second ribs 12 of the propeller fan 100 according to Embodiment 1 of the present invention.

FIG. 10 illustrates a third example of the shape of the second ribs 12. As illustrated in FIG. 10, in the third example, the second ribs 12 have the same shapes as those of turbo blades as in the second example. To be more specific, the second distal end portion 12*b* is located rearward of the second proximal end portion 12*a* in the rotation direction of the propeller fan 100. Part of each of the second ribs 12 that is located between the second proximal end portion 12*a* and the second distal end portion 12*b* is curved or bent rearwards in the rotation direction.

Figure 11:
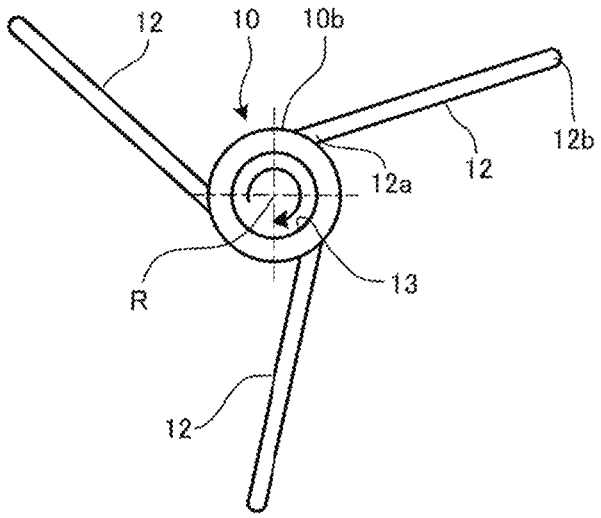
FIG. 11 illustrates a fourth example of the shape of the second ribs 12 of the propeller fan 100 according to Embodiment 1 of the present invention.

FIG. 11 illustrates a fourth example of the shape of the second ribs 12. As illustrated in FIG. 11, in the fourth example, the second ribs 12 have the same shapes as those of sirocco blades. To be more specific, the second distal end portion 12*b* is located forward of the second proximal end portion 12*a* in the rotation direction of the propeller fan 100. Each of the second ribs 12 linearly extends from the second proximal end portion 12*a* to the second distal end portion 12*b* while inclined forwards in the rotation direction relative to the radial direction from the rotation axis R.

Figure 12:
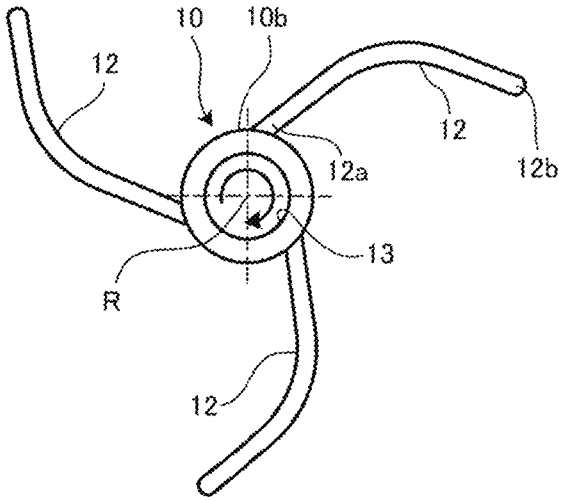
FIG. 12 illustrates a fifth example of the shape of the second ribs 12 of the propeller fan 100 according to Embodiment 1 of the present invention.

FIG. 12 illustrates a fifth example of the shape of the second ribs 12. As illustrated in FIG. 12, in the fifth example, the second ribs 12 have the same shapes as those of sirocco blades as in the fourth example. To be more specific, the second distal end portion 12*b* is located forward of the second proximal end portion 12*a* in the rotation direction of the propeller fan 100. Part of each of the second ribs 12 that is located between the second proximal end portion 12*a* and the second distal end portion 12*b* is curved or bent forwards in the rotation direction.

All the second ribs 12 that are of different types as illustrated in FIGS. 8 to 12 can aerodynamically act as described above. Therefore, even if any type of second ribs 12 which are selected from all the types of the second ribs 12 as illustrated in FIGS. 8 to 12 are applied, they can improve the air-sending efficiency of the propeller fan 100. Especially, in the case where of all the types of the second ribs 12, the second ribs having the same shapes as those of the turbo fan shape as illustrated in FIGS. 9 and 10 are applied, they can reduce an air resistance during the rotation of the second ribs 12, and thus can further improve the efficiency of the propeller fan 100. Particularly, the second ribs 12 curved or bent rearwards in the rotation direction as illustrated in FIG. 10 can more greatly reduce the air resistance than as the second ribs 12 as illustrated in FIG. 9.

As described above, the propeller fan 100 according to Embodiment 1 includes the tubular shaft portion 10 which is cylindrically formed and provided on the rotation axis R, the plurality of blades 20 which are provided on the outer peripheral side of the shaft portion 10, the connection portions 25 which are provided adjacent to the shaft portion 10 and each of which connects associated two of the plurality of blades 20 that are adjacent to each other in the circumferential direction, the first ribs 11 each of which is provided on at least one of the pressure surface 20*a* of an associated one of the plurality of blades 20 and the surface 25*a* of an associated one of the connection portions 25, which is provided on a downstream side in the flow of air, the first ribs 11 extending from the shaft portion 10 outwards in the radial direction, and the second ribs 12 each provided on at least one of the negative-pressure surface 20*b* of an associated one of the plurality of blades 20 and the surface 25*b* of an associated one of the connection portions 25, which is provided on an upstream side in the flow of air, the second ribs 12 extending outwards from the shaft portion 10 in the radial direction.

In the above configuration, the first ribs 11 and the second ribs 12 structurally reinforce the shaft portion 10, the plurality of blades 20, and the plurality of connection portions 25. Thus, the shaft portion 10 can be formed to have a smaller diameter, and stagnation regions generated on downstream and upstream sides of the shaft portion 10 can be reduced in size. The first ribs 11 and the second ribs 12 can also generate air flows on the downstream and upstream sides of the shaft portion 10. Thus, the stagnation regions generated on the downstream and upstream of the shaft portion 10 can be further reduced in size or can be eliminated. Therefore, in Embodiment 1, it is possible to improve the air-sending efficiency of the propeller fan 100.

In the propeller fan 100 according to Embodiment 1, as viewed in the direction parallel to the rotation axis R, each first rib 11 includes the first proximal end portion 11*a* connected to the shaft portion 10, and the first distal end portion 11*b* located outward of t the first proximal end portion 11*a* in the radial direction. In each of the examples as illustrated in FIGS. 4 and 5, the first distal end portion 11*b* is located rearward of the first proximal end portion 11*a* in the rotation direction of the shaft portion 10. In this configuration, it is possible to reduce the air resistance during the rotation of the first ribs 11, and thus improve the air-sending efficiency of the propeller fan 100.

In the propeller fan 100 according to Embodiment 1, as viewed in the direction parallel to the rotation axis R, each second rib 12 includes the second proximal end portion 12*a* connected to the shaft portion 10, and the second distal end portion 12*b* located outward of the second proximal end portion 12*a* in the radial direction. In each of the examples as illustrated in FIG. 9 and FIG. 10, the second distal end portion 12*b* is located rearward of the second proximal end portion 12*a* in the rotation direction of the shaft portion 10. In this configuration, it is possible to reduce the air resistance during the rotation of the second ribs 12, and thus further improve the air-sending efficiency of the propeller fan 100.

Embodiment 2

Figure 13:
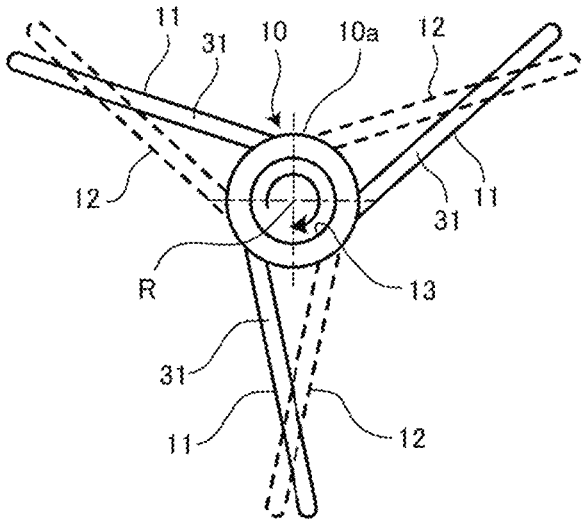
FIG. 13 illustrates a configuration of first ribs 11 and second ribs 12 at a propeller fan 100 according to Embodiment 2 of the present invention as viewed in a direction parallel to a rotation axis R thereof.

A propeller fan according to Embodiment 2 of the present invention will be described. FIG. 13 illustrates a configuration of the first ribs 11 and the second ribs 12 of a propeller fan 100 according to Embodiment 2 as viewed in the direction parallel to the rotation axis R. The configuration of the first ribs 11 and the second ribs 12 as illustrated in FIG. 13 are also that as viewed from the pressure surface 20*a*. As illustrated in FIG. 13, as viewed in the direction parallel to the rotation axis R, the first ribs 11 and the second ribs 12 are arranged to cross each other. To be more specific, the first ribs 11 and the second ribs 12 cross each other when projected on a plane perpendicular the rotation axis R in the direction parallel to the rotation axis R. In Embodiment 2, the first ribs 11 have the same shapes as those of turbo blades and each second rib 12 have the same shapes as those of sirocco blades. However, a combination of the shapes of the first ribs 11 and the second ribs 12 is not limited to any of the above shapes. The first ribs 11 and the second ribs 12 may be arranged to at least overlap each other as viewed in the direction parallel to the rotation axis R.

Figure 14:
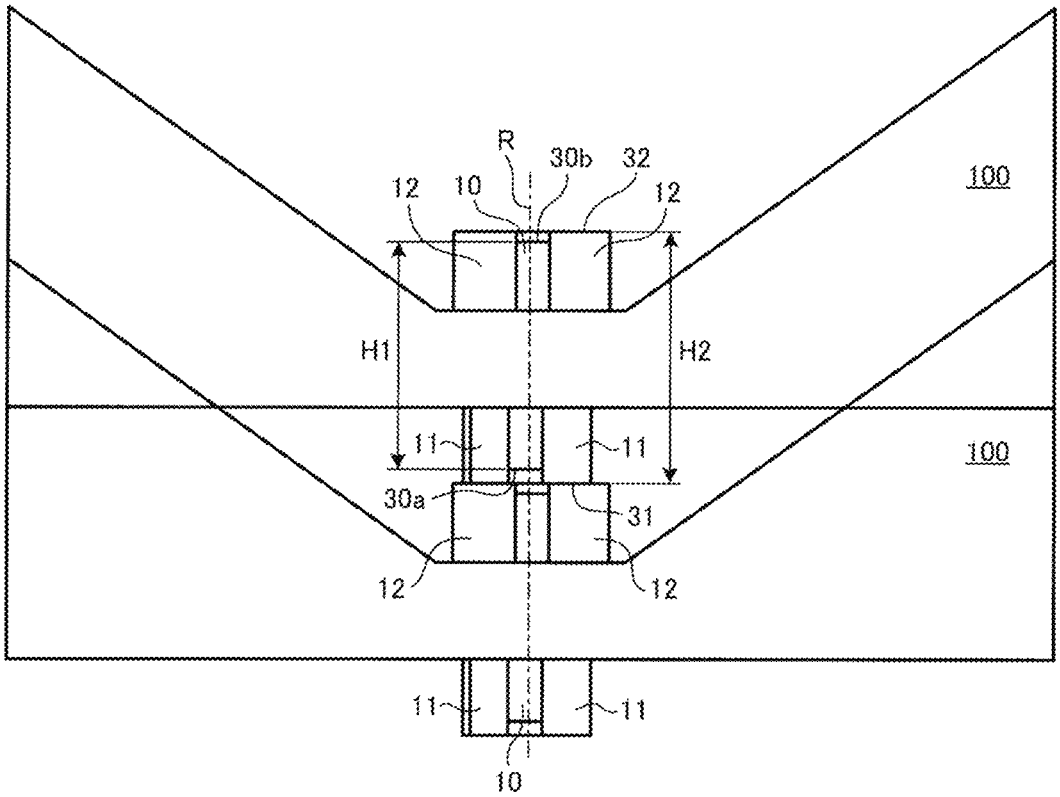
FIG. 14 is a schematic side view illustrating a stacked state of a plurality of propeller fans 100 according to Embodiment 2 of the present invention in an axial direction thereof.

FIG. 14 is a schematic side view illustrating a stacked state of a plurality of propeller fans 100 according to Embodiment 2 in the axial direction. As illustrated in FIG. 14, the shaft portion 10 of each propeller fan 100 includes a first end portion 30*a* and a second end portion 30*b* as its both end portions in the direction parallel to the rotation axis R, the first end portion 30*a* being located on the downstream side, the second end portion 30*b* being located on the upstream side. Each of the first ribs 11 of each propeller fan 100 has a downstream end portion 31 located at a downstream end of the first rib 11 in the flow of air, as an end portion of the first rib 11 in a protrusion direction thereof. Each of the second ribs 12 of each propeller fan 100 has an upstream end portion 32 located at an upstream end of the second rib 12 in the flow of air, as an end portion of the second rib 12 in the protrusion direction. The downstream end portion 31 and the upstream end portion 32 both have a flat surface substantially perpendicular to the rotation axis R.

It should be noted that the relationship "$H1 \leq H2$" is satisfied, where H1 is the distance between the first end portion 30*a* and the second end portion 30*b* of the shaft portion 10 of each propeller fan 100 in the direction parallel to the rotation axis R, and H2 is the distance between the downstream end portion 31 of each first rib 11 and the upstream end portion 32 of an associated second rib 12 at each propeller fan 100 in the direction parallel to the rotation axis R. Thus, while the propeller fans 100 are stacked together in the axial direction, the downstream end portions 31 of the first ribs 11 of an upper one of the propeller fans 100 come into contact with the upstream end portions 32 of the second ribs 12 of a lower one of the propeller fans 100. The first end portion 30*a* of the shaft portion 10 of the upper propeller fan 100 and the second end portion 30*b* of the shaft portion 10 of the lower propeller fan 100 come into contact with each other, or face each other, with space interposed between the first end portion 30*a* and the second end portion 30*b*.

As described above, in the propeller fan 100 according to Embodiment 2, the first ribs 11 and the second ribs 12 are arranged to cross each other as viewed in the direction parallel to the rotation axis R; and H1≤H2 is satisfied, where H1 is the distance between the first end portion 30*a* and the second end portion 30*b* of the shaft portion 10 in the direction parallel to the rotation axis R, and H2 is the distance between the downstream end portion 31 of each first rib 11 and the upstream end portion 32 of the associated second rib 12 in the direction parallel to the rotation axis R.

In the above configuration, when the propeller fans 100 are stacked in the axial direction, the second ribs 12 of the lower one of the propeller fans 100 and the first ribs 11 of the upper one of the propeller fans 100 can be brought into contact with each other at areas located outward of the shaft portion 10. Thus, when the propeller fans 100 are temporarily taken in keeping, they can be stably stacked in the axial direction.

Embodiment 3

Figure 15:
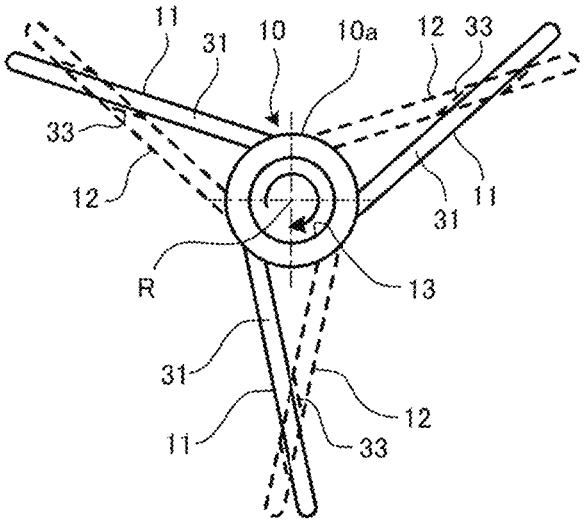
FIG. 15 illustrates a configuration of first ribs 11 and second ribs 12*a* at a propeller fan 100 according to Embodiment 3 of the present invention as viewed in a direction parallel to a rotation axis R thereof.

A propeller fan according to Embodiment 3 of the present invention will be described. FIG. 15 illustrates a configuration of the first ribs 11 and the second ribs 12 at a propeller fan 100 according to Embodiment 3 as viewed in the direction parallel to the rotation axis R. Also, the configuration of the first ribs 11 and the second ribs 12 as illustrated by FIG. 15 is that as viewed from the pressure surface 20*a*. As illustrated in FIG. 15, a groove-shaped recess 33 is formed in the upstream end portion 32 of each of the second ribs 12 in an area where the second rib 12 and the associated first rib 11 cross each other as viewed in the direction parallel to the rotation axis R. The recess 33 of each second rib 12 extends along the associated first rib 11 as viewed in the direction parallel to the rotation axis R, and has a groove width greater than or equal to the plate thickness of the first rib 11.

Figure 16:
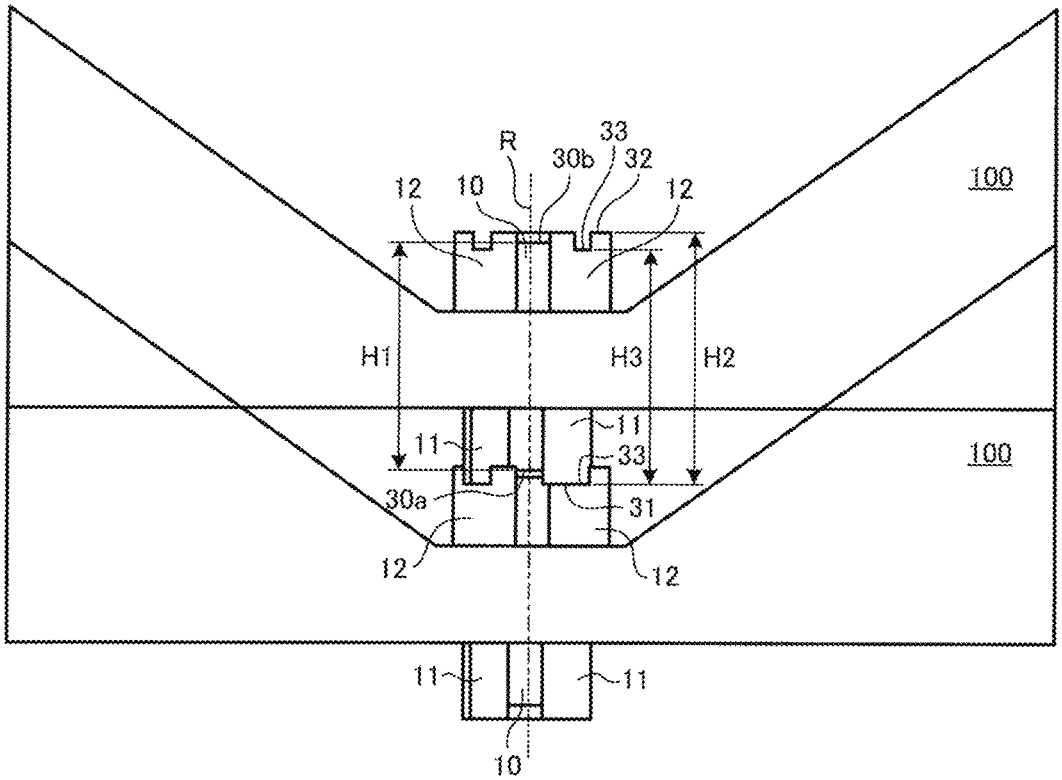
FIG. 16 is a schematic side view illustrating a stacked state of a plurality of propeller fans 100 according to Embodiment 3 of the present invention in an axial direction thereof.

FIG. 16 is a schematic side view of a stacked state of a plurality of propeller fans 100 according to Embodiment 3 in the axial direction. It should be noted that H1≤H3<H2" is satisfied, where H3 is the distance between the downstream end portion 31 of each first rib 11 and the bottom portion of the recess 33 of the associated second rib 12 in the direction parallel to the rotation axis R, and as described with respect to Embodiment 2, H1 is the distance between the first end portion 30*a* and the second end portion 30*b* of the shaft portion 10 in the direction parallel to the rotation axis R, and H2 is the distance between the downstream end portion 31 of each first rib 11 and the upstream end portion 32 of the associated second rib 12 in the direction parallel to the rotation axis R. Thus, the first ribs 11 of an upper one of the propeller fans 100 are fitted into the recesses 33 of a lower one of the propeller fans 100. The downstream end portions 31 of the first ribs 11 fitted into the recesses 33 come into contact with the bottom portions of the recesses 33. The first end portion 30*a* of the shaft portion 10 of the upper propeller fan 100 comes into contact with the second end portion 30*b* of the shaft portion 10 of the lower propeller fan 100, or faces the second end portion 30*b*, with space interposed between the first end portion 30*a* and the second end portion 30*b*.

Figure 17:
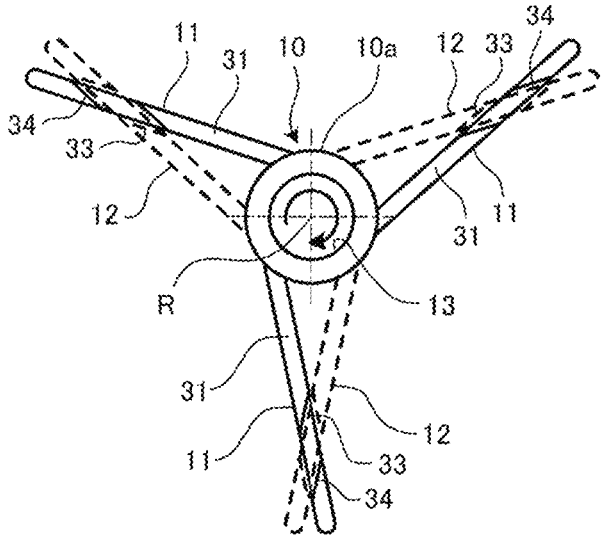
FIG. 17 illustrates a configuration of first ribs 11 and second ribs 12 at a propeller fan 100 according to a modification of Embodiment 3 of the present invention as viewed in a direction parallel to a rotation axis R thereof.

FIG. 17 illustrates a configuration of the first ribs 11 and the second ribs 12 at a propeller fan 100 according to a modification of Embodiment 3 as viewed in the direction parallel to the rotation axis R. In the modification, in addition to the recess 33 of each second rib 12, a groove-shaped recess 34 is also formed in the downstream end portion 31 of each first rib 11. To be more specific, the recess 34 of each first rib 11 is formed in the downstream end portion 31 in an area where the first rib 11 and the associated second rib 12 cross each other as viewed in the direction parallel to the rotation axis R. The recess 34 of each first rib 11 extends along the associated second rib 12 as viewed in the direction parallel to the rotation axis R, and has a groove width greater than or equal to the plate thickness of the second rib 12. In this case, the distance between the bottom portion of the recess 34 of each first rib 11 and the bottom portion of the recess 33 of the associated second rib 12 is H3. That is, the distance H3 between the bottom portion of the recess 34 of each first rib 11 and the bottom portion of the recess 33 of the associated second rib 12 satisfies H1≤H3<H2. Thus, the recesses 34 of the first ribs 11 of the upper propeller fan 100 and the recesses 33 of the second ribs 12 of the lower propeller fan 100 fit to each other. The bottom portion of the recess 34 of each first rib 11 of the upper propeller fan 100 comes into contact with the bottom portion of the recess 33 of the associated second rib 12 of the lower propeller fan 100.

Regarding the recess 33 or the recess 34 in Embodiment 3, it suffices that the recess 33 or the recess 34 is formed in at least one of the downstream end portion 31 of each first rib 11 and the upstream end portion 32 of each second rib 12.

As described above, in the propeller fan 100 according to Embodiment 3, the recess 33 or the recess 34 is formed in at least one of the downstream end portion 31 and the upstream end portion 32 in an area where each first rib 11 and the associated second rib 12 cross each other as viewed in the direction parallel to the rotation axis R. In this configuration, in the case where the plurality of propeller fans 100 are stacked in the axial direction, the recesses can be fitted to the ribs or the recesses can be fitted to associated recesses. Therefore, when stacked in the axial direction, the plurality of propeller fans 100 can be easily positioned relative to each other, and it is possible to reduce displacement of the propeller fans 100 from each other in the rotation direction.

Embodiment 4

Figure 18:
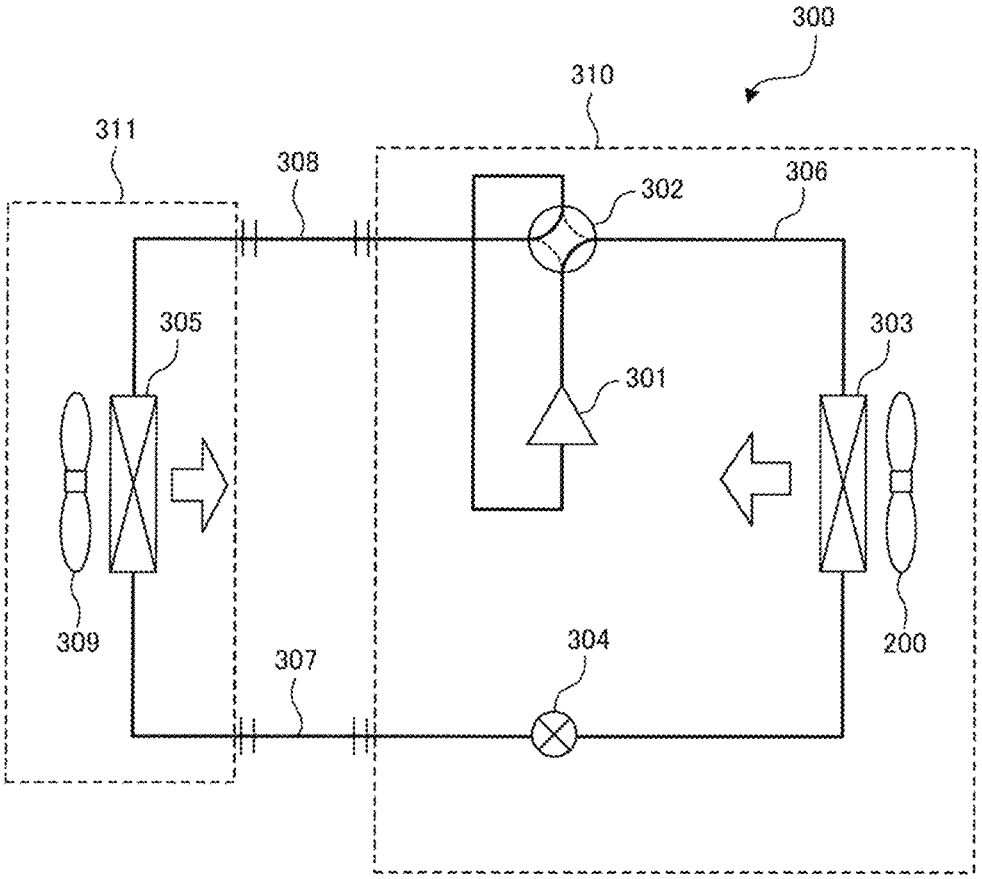
FIG. 18 is a refrigerant circuit diagram illustrating a configuration of a refrigeration cycle apparatus 300 according to Embodiment 4 of the present invention.

An air-sending device and a refrigeration cycle apparatus according to Embodiment 4 of the present invention will be described. FIG. 18 is a refrigerant circuit diagram illustrating a configuration of the refrigeration cycle apparatus 300 according to Embodiment 4. Embodiment 4 will be described by referring to by way of example the case where an air-conditioning apparatus is used as the refrigeration cycle apparatus 300. However, the refrigeration cycle apparatus according to Embodiment 4 is also applicable as, for example, a refrigerating machine or a water heater. As illustrated in FIG. 18, the refrigeration cycle apparatus 300 includes a refrigerant circuit 306 in which a compressor 301, a four-way valve 302, a heat-source-side heat exchanger 303, a pressure-reducing device 304, and a load-side heat exchanger 305 are successively connected by refrigerant pipes. Furthermore, the refrigeration cycle apparatus 300 includes an outdoor unit 310 and an indoor unit 311. In the outdoor unit 310, the compressor 301, the four-way valve 302, the heat-source-side heat exchanger 303, the pressure-reducing device 304, and an air-sending device 200 are provided, the air-sending device 200 being provided to send outdoor air to the heat-source-side heat exchanger 303. In the indoor unit 311, the load-side heat exchanger 305 and an air-sending device 309 are provided, the air-sending device 309 being provided to send air to the load-side heat exchanger 305. The outdoor unit 310 and the indoor unit 311 are connected to each other by two extension pipes 307 and 308, which are part of refrigerant pipes.

The compressor 301 is a fluid device that compresses sucked refrigerant and discharges the refrigerant. The four-way valve 302 is a device that switches a flow passage for refrigerant between a flow passage for a cooling operation and a flow passage for a heating operation under control by a controller not illustrated. The heat-source-side heat exchanger 303 is a heat exchanger that transfers heat between refrigerant that flows in the heat exchanger and outdoor air sent from the air-sending device 200. The heat-source-side heat exchanger 303 operates as a condenser during the cooling operation, and operates as an evaporator during the heating operation. The pressure-reducing device 304 is a device that reduces the pressure of the refrigerant. As the pressure-reducing device 304, an electronic expansion valve whose opening degree is adjusted by the control by the controller can be used. The load-side heat exchanger 305 is a heat exchanger that transfers heat between refrigerant that flows in the heat exchanger and air sent from the air-sending device 309. The load-side heat exchanger 305 operates as an evaporator during the cooling operation, and operates as a condenser during the heating operation.

FIG. 19 is a perspective view of an internal configuration of the outdoor unit 310 of the refrigeration cycle apparatus 300 according to Embodiment 4. As illustrated in FIG. 19, the inside of the housing of the outdoor unit 310 is partitioned into a device chamber 312 and an air-sending-device chamber 313. The device chamber 312 houses components such as the compressor 301 and a refrigerant pipe 314. A board box 315 is provided in an upper portion of the device chamber 312. The board box 315 houses a control board 316 that forms the controlling device. The air-sending-device chamber 313 houses the air-sending device 200 and the heat-source-side heat exchanger 303. The air-sending device 200 sends air to the heat-source-side heat exchanger 303. The air-sending device 200 includes the propeller fan 100 according to any one of Embodiments 1 to 3, and the fan motor 110 that drives the propeller fan 100. The drive shaft 111 of the fan motor 110 is connected to the shaft hole 13 (not illustrated in FIG. 19) of the propeller fan 100. The fan motor 110 is supported by the support element 120. The fan motor 110 and the support element 120 are both located upstream of the propeller fan 100 in the flow of air.

As described above, the air-sending device 200 according to Embodiment 4 includes the propeller fan 100 according to any one of Embodiments 1 to 3. Also, the refrigeration cycle apparatus 300 according to Embodiment 4 includes the air-sending device 200 according to Embodiment 4. In Embodiment 4, it is possible to obtain the same advantages as in any one of Embodiments 1 to 3.

The above embodiments can be put to practical use in combination.

REFERENCE SIGNS LIST

10 shaft portion, 10*a* downstream-side shaft portion, 10*b* upstream-side shaft portion, 11 first rib, 11*a* first proximal end portion, 11*b* first distal end portion, 12 second rib, 12*a* second proximal end portion, 12*b* second distal end portion, 13 shaft hole, 20 blade, 20*a* positive-pressure surface, 20*b* negative-pressure surface, 21 leading edge, 22 trailing edge, 23 outer peripheral edge, 25 connection portion, 25*a*, 25*b* surface, 25*c* edge portion, 30*a* first end portion, 30*b* second end portion, 31 downstream end portion, 32 upstream end portion, 33, 34 recess, 100 propeller fan, 110 fan motor, 111 drive shaft, 120 support element, 200 air-sending device, 300 refrigeration cycle apparatus, 301 compressor, 302 four-way valve, 303 heat-source-side heat exchanger, 304 pressure-reducing device, 305 load-side heat exchanger, 306 refrigerant circuit, 307, 308 extension pipe, 309 air-sending device, 310 outdoor unit, 311 indoor unit, 312 device chamber, 313 air-sending-device chamber, 314 refrigerant pipe, 315 board box, 316 control board, C1 imaginary cylindrical surface, R rotation axis

The invention claimed is:

1. A propeller fan comprising:

a cylindrical shaft portion provided on a rotation axis of the propeller fan;

a plurality of blades provided on an outer peripheral side of the shaft portion and each having a positive-pressure surface and a negative-pressure surface; and a connection portion provided adjacent to the shaft portion and configured to connect two of the plurality of blades that are adjacent to each other in a circumferential direction of the propeller fan, wherein the shaft portion includes a downstream-side shaft portion that protrudes in a region where the positive-pressure surface is located, and an upstream-side shaft portion that protrudes in a region where the negative-pressure surface is located, the propeller fan further comprising:

a first rib provided on at least one of the positive-pressure surface of each of the plurality of blades and a surface of part of the connection portion that is located on a downstream side in a flow of air, the first rib extending outwards from the downstream-side shaft portion in a radial direction of the propeller fan; and a second rib provided on at least one of the negative-pressure surface of each of the plurality of blades and a surface of part of the connection portion that is located on an upstream side in the flow of air, the second rib extending outwards from the upstream-side shaft portion in the radial direction, wherein the first rib and the second rib are arranged to cross each other as viewed in a direction parallel to the rotation axis, wherein $H1 \leq H2$ is satisfied, where H1 is a distance between one end and an other end of the shaft portion in the direction parallel to the rotation axis, and H2 is a distance between a downstream end portion of the first rib and an upstream end portion of the second rib in the direction parallel to the rotation axis, and wherein a recess is formed in at least one of the downstream end portion and the upstream end portion in an area where the first rib and the second rib cross each other as viewed in the direction parallel to the rotation axis.

2. The propeller fan of claim 1, wherein the first rib includes a first proximal end portion and a first distal end portion, the first proximal end portion being connected to the shaft portion, the first distal end portion being located outward of the first proximal end portion in the radial direction, and wherein the first distal end portion is located rearward of the first proximal end portion in a rotation direction of the shaft portion.

3. The propeller fan of claim 1, wherein the second rib includes a second proximal end portion and a second distal end portion, the second proximal end portion being connected to the shaft portion, the second distal end portion being located outward of the second proximal end portion in the radial direction, and wherein the second distal end portion is located rearward of the second proximal end portion in a rotation direction of the shaft portion.

4. An air-sending device comprising:

the propeller fan of claim 1; and a fan motor configured to drive the propeller fan.

5. A refrigeration cycle apparatus comprising the air-sending device of claim 4.

6. The propeller fan of claim 1, wherein the first rib extends outwards from an outer peripheral surface of the downstream-side shaft portion in the radial direction.

7. The propeller fan of claim 1, wherein the second rib extends outwards from an outer peripheral surface of the upstream-side shaft portion in the radial direction.

8. A propeller fan comprising:

a cylindrical shaft portion provided on a rotation axis of the propeller fan;

a plurality of blades provided on an outer peripheral side of the shaft portion;

a connection portion provided adjacent to the shaft portion and configured to connect two of the plurality of blades that are adjacent to each other in a circumferential direction of the propeller fan;

a first rib provided on at least one of a positive-pressure surface of each of the plurality of blades and a surface of part of the connection portion that is located on a downstream side in a flow of air, the first rib extending outwards from the shaft portion in a radial direction of the propeller fan; and a second rib provided on at least one of a negative-pressure surface of each of the plurality of blades and a surface of part of the connection portion that is located on an upstream side in the flow of air, the second rib extending outwards from the shaft portion in the radial direction, wherein the first rib and the second rib are arranged to cross each other as viewed in a direction parallel to the rotation axis, wherein $H1 \leq H2$ is satisfied, where H1 is a distance between one end and an other end of the shaft portion in the direction parallel to the rotation axis, and H2 is a distance between a downstream end portion of the first rib and an upstream end portion of the second rib in the direction parallel to the rotation axis, and wherein a recess is formed in at least one of the downstream end portion and the upstream end portion in an area where the first rib and the second rib cross each other as viewed in the direction parallel to the rotation axis.

9. An air-sending device comprising:

the propeller fan of claim 8; and a fan motor configured to drive the propeller fan.

10. A refrigeration cycle apparatus comprising the air-sending device of claim 9.

* * * * *